US007520735B2

(12) United States Patent
Merrill et al.

(10) Patent No.: US 7,520,735 B2
(45) Date of Patent: Apr. 21, 2009

(54) NESTED BELLOWS EXPANSION MEMBER FOR A SUBMERSIBLE PUMP

(75) Inventors: Daniel A. Merrill, Claremore, OK (US); Leslie C. Reid, Coweta, OK (US)

(73) Assignee: Baker Hughes Incorporated, Houston, TX (US)

( * ) Notice: Subject to any disclaimer, the term of this patent is extended or adjusted under 35 U.S.C. 154(b) by 612 days.

(21) Appl. No.: 10/851,474

(22) Filed: May 21, 2004

(65) Prior Publication Data

US 2005/0008514 A1 Jan. 13, 2005

Related U.S. Application Data

(63) Continuation-in-part of application No. 10/350,788, filed on Jan. 23, 2003, now Pat. No. 6,851,935.

(51) Int. Cl.
*F04B 35/04* (2006.01)

(52) U.S. Cl. ..... 417/423.11; 417/423.3; 310/87

(58) Field of Classification Search ..... 417/423.3, 417/423.11; 310/87
See application file for complete search history.

(56) References Cited

U.S. PATENT DOCUMENTS

| | | | | |
|---|---|---|---|---|
| 2,258,064 | A * | 10/1941 | Myers | 310/86 |
| 2,423,436 | A | 7/1947 | Blom | |
| 3,947,709 | A | 3/1976 | Waltman | |
| 4,406,462 | A | 9/1983 | Witten | |
| 4,421,999 | A | 12/1983 | Beavers et al. | |
| 4,436,488 | A | 3/1984 | Witten | |
| 4,992,689 | A | 2/1991 | Bookout | |
| 5,622,222 | A | 4/1997 | Wilson et al. | |
| 6,059,539 | A * | 5/2000 | Nyilas et al. | 417/414 |
| 6,242,829 | B1 | 6/2001 | Scarsdale | |
| 6,307,290 | B1 | 10/2001 | Scarsdale | |
| 6,688,860 | B2 * | 2/2004 | Du et al. | 417/423.11 |
| 6,851,935 | B2 * | 2/2005 | Merrill et al. | 417/423.3 |
| 2002/0192090 | A1 * | 12/2002 | Du et al. | 417/423.11 |
| 2004/0146415 | A1 * | 7/2004 | Merrill et al. | 417/414 |

FOREIGN PATENT DOCUMENTS

| | | |
|---|---|---|
| CN | 1080366 A | 5/1994 |
| GB | 2336474 A | 10/1999 |
| GB | 0213302.3 | 12/2002 |

* cited by examiner

*Primary Examiner*—Charles G. Freay
*Assistant Examiner*—Peter J Bertheaud
(74) *Attorney, Agent, or Firm*—Fellers, Snider, Blankenship, Bailey & Tippens

(57) ABSTRACT

A multi-diameter bellows for use in a seal section of a submersible pump. The bellows is adapted to surround a shaft that communicates the motor with the pump. The bellows is made of a first collapsible section and a second collapsible section. The volume of the bellows is varied by moving a coupling member that attaches the first collapsible section to the second collapsible section. The coupling member has an outside portion for connecting to the second collapsible section and an inside portion for connecting to the first collapsible section. The coupling member additionally has a transitional section between the outside portion and the inside portion. The transitional portion of the coupling member allows the inside portion to be located within the second collapsible section, i.e., allows the collapsible sections to be "nested", which increases displaced volume for a given stroke length of the coupling member.

8 Claims, 8 Drawing Sheets

NESTED BELLOWS EXPANSION MEMBER FOR A SUBMERSIBLE PUMP

CROSS REFERENCE TO RELATED APPLICATION

This application is a continuation-in-part of U.S. patent application Ser. No. 10/350,788, filed on Jan. 23, 2003, and incorporated herein by reference.

BACKGROUND OF THE INVENTION

1. Field of the Invention

This invention relates generally to a seal section for an electrical submersible pump. More particularly, the invention relates to a bellows in a seal section of an electrical submersible pump.

2. Background

Electrical submersible pumps (ESPs) have been used to lift fluid from bore holes, particularly for oil production. In operation, a pump of an electrical submersible pump is placed below the fluid level in the bore hole. The well fluid often contains corrosive compounds such as brine water, $CO_2$, and $H_2S$ that can shorten the run life of an ESP when the ESP is submerged in the well fluid. Corrosion resistant units have been developed that have motors that utilize seals and barriers to exclude the corrosive agents from the internal mechanisms of the ESP.

A typical submersible pump has a motor, a pump above the motor, and a seal section between the motor and the pump. The seal section allows for expansion of the dielectric oil contained in the rotor gap of the motor. Temperature gradients resulting from an ambient and motor temperature rise cause the dielectric oil to expand. The expansion of the oil is accommodated by the seal section. Additionally, the seal section is provided to equalize the casing annulus pressure with the internal dielectric motor fluid. The equalization of pressure across the motor helps keep well fluid from leaking past sealed joints in the motor. It is important to keep well fluids away from the motor because well fluid that gets into the motor will cause early dielectric failure. Measures commonly employed to prevent well fluids from getting into the motor include the use of elastomeric bladders as well as labyrinth style chambers to isolate the well fluid from the clean dielectric motor fluid. Multiple mechanical shaft seals keep the well fluid from leaking down the shaft. The elastomeric bladder provides a positive barrier to the well fluid. The labyrinth chambers provide fluid separation based on the difference in densities between well fluid and motor oil. Any well fluid that gets past the upper shaft seals or the top chamber is contained in the lower labyrinth chambers as a secondary protection means.

One problem with the use of an elastomeric bladder is that, in high temperature applications, elastomeric bladders may experience a short usable life or may not be suitable for use. Elastomeric materials having a higher temperature tolerance tend to be very expensive. An alternative is to replace the elastomeric bladder with a bellows made of metal or another material that may expand as necessary, but which is suitable for use in high temperature applications, and/or which provide improved reliability over an elastomeric bladder.

Bellows have been used previously in submersible pump applications and other pumping systems. For example, the use of bellows is taught in U.S. Pat. Nos. 2,423,436, 6,059,539, and 6,242,829. Previous use of bellows in an ESP has required that the bellows be placed in an awkward configuration, e.g., as taught in U.S. Pat. No. 2,423,436, or that the bellows be located below the motor in an ESP to avoid interfering with a shaft that traverses the length of the ESP to deliver power from the motor to the pump.

It is desirable to be able to use a bellows to replace an elastomeric expansion bag, and that the bellows be configured in a similar manner to the more commonly used elastomeric expansion bag.

SUMMARY OF THE INVENTION

According to the present invention there is provided an improvement in a positive barrier to well fluid in a submersible pump, wherein the barrier is suitable for high temperature applications.

A multi-diameter bellows provides a positive barrier to well fluids. The multi-diameter bellows is preferably located in a seal section to assist in allowing expansion of the dielectric oil, to equalize the casing annulus pressure with the internal dielectric motor fluid and to isolate the well fluid from the clean dielectric motor fluid. The multi-diameter bellows of the invention may be made from materials that are less expensive and are suitable for higher temperatures than an elastomeric bag.

The multi-diameter bellows of the invention is preferably located in a bellows chamber of a seal section of an electrical submersible pump, wherein the seal section is located between a pump and a motor. The bellows chamber has a first end and a second end. A shaft communicates the motor with the pump, and runs through the bellows chamber in the seal section. The bellows is located in the bellows chamber and surrounds the shaft. The bellows is made of a first collapsible section and a second collapsible section. The first collapsible section communicates with the first end of the bellows chamber. The first collapsible section has a first cross-sectional area, e.g., a relatively large diameter. The second collapsible section communicates with the second end of the bellows chamber. The second collapsible section has a second cross-sectional area, e.g., a relatively small diameter. A first coupling member, e.g., a coupling ring, is provided between the first collapsible section and the second collapsible section and also surrounds said shaft. A volume within the bellows is varied by movement of the first coupling member towards either of the first end and the second end.

In a second embodiment of the bellows of the invention, a large diameter section is attached to the bellows chamber at a first end. A second end of the large diameter section has a coupling member thereon, which transitions the bellows from the first large diameter section to a small diameter section. On the other end of the small diameter section, a second coupling member is provided to transition the small diameter section to a second large diameter section, which is affixed to the other end of the bellows chamber. In both embodiments, the ends of the bellows are fixed. The volume within the bellows is varied by movement of the coupling member or coupling members. For example, to increase the volume of the bellows, the coupling member or coupling members are displaced to minimize the volume of the small diameter section and to maximize the volume of the large diameter sections. Conversely, to decrease the volume of the bellows, the coupling members are displaced to maximize the volume of the small diameter section and to minimize the volume of the large diameter section. One advantage of the second bellows embodiment is that the bellows is still partially functional even if one of the coupling members becomes stuck, thereby increasing reliability of the seal section.

In another embodiment of the invention, a coupling member may be utilized that is adapted to facilitate a nested bellows. For example, a coupling member may be provided with an outside portion for engaging an end surface of a large diameter bellows. A transitional portion of the coupling member preferably extends inside of the large diameter bellows. An inside portion of the coupling member may be provided for affixing to an end surface of a small diameter bellows. Preferably, the transitional portion of the coupling member extends within the large diameter bellows so that the inside portion of the coupling member is located within the large diameter bellows. Therefore, the outside portion of the coupling member lies in a different plane than the inside portion of the coupling member, since the outside portion and inside portion are spaced apart by the transitional portion. As a result, a portion of the small diameter bellows extends within a portion of the large diameter bellows, i.e., is "nested" therein. A result of nesting the bellows is that for a given length of a bellows chamber, volume displaced by a multi-diameter bellows may be increased.

A better understanding of the present invention, its several aspects, and its advantages will become apparent to those skilled in the art from the following detailed description, taken in conjunction with the attached drawings, wherein there is shown and described the preferred embodiment of the invention, simply by way of illustration of the best mode contemplated for carrying out the invention.

DETAILED DESCRIPTION OF THE PREFERRED EMBODIMENT

Before explaining the present invention in detail, it is important to understand that the invention is not limited in its application to the details of the embodiments and steps described herein. The invention is capable of other embodiments and of being practiced or carried out in a variety of ways. It is to be understood that the phraseology and terminology employed herein is for the purpose of description and not of limitation.

Figure 1A:
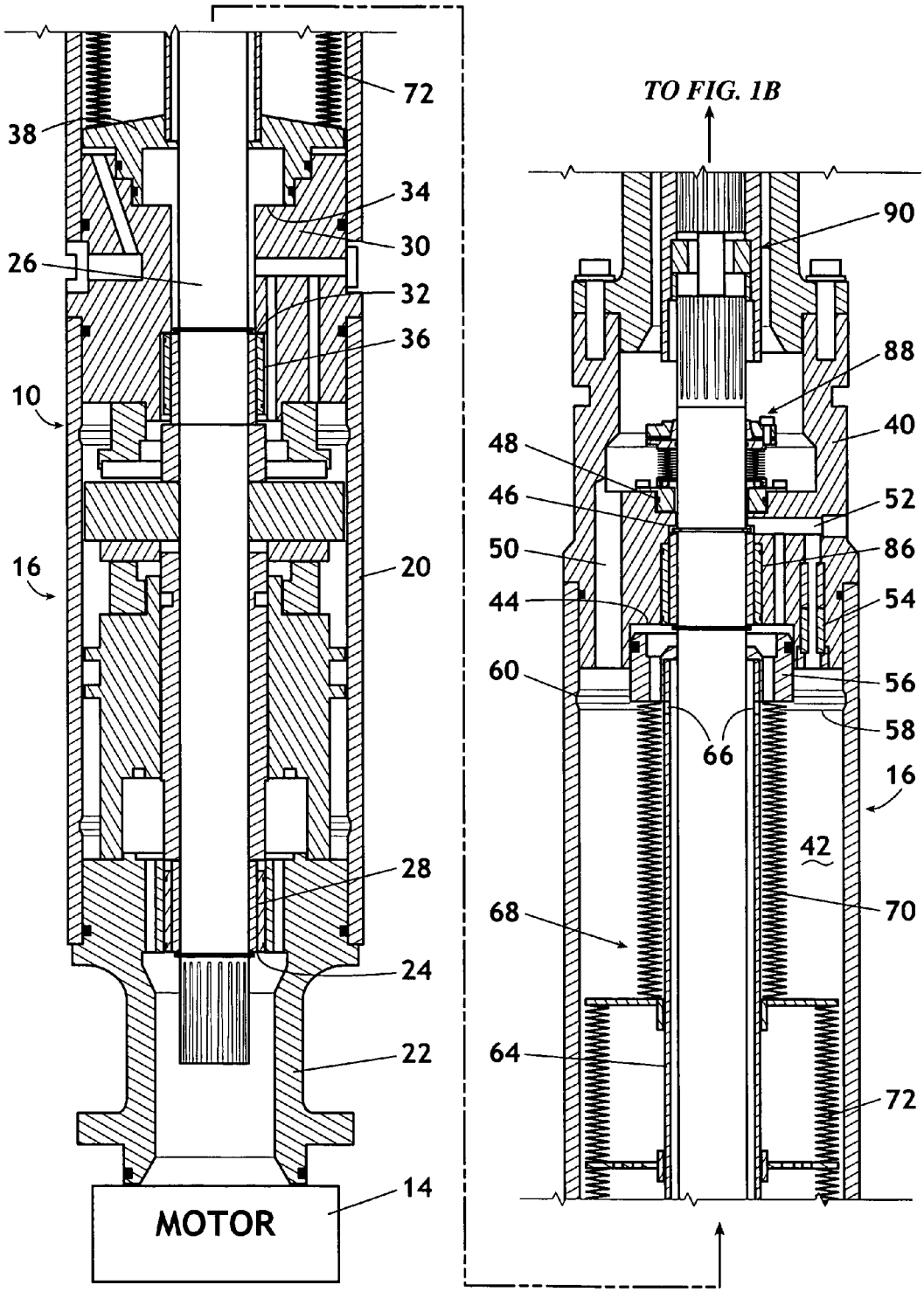
FIG. 1A is a cross-sectional view of a lower section seal section for an electrical submersible pump having a first embodiment of a multi-diameter metal bellows.
Figure 1B:
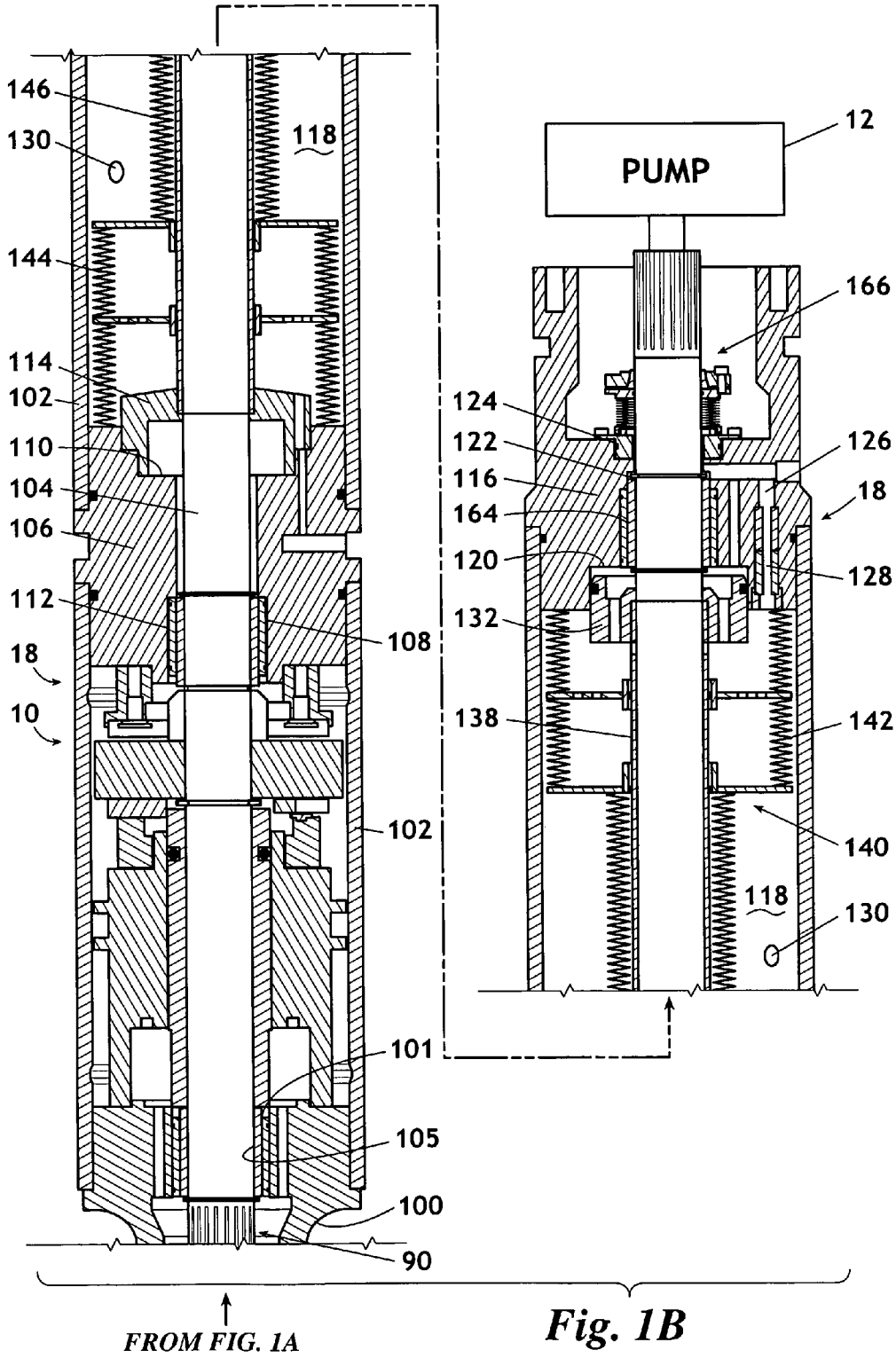
FIG. 1B is a cross-sectional view of an upper section of a seal section for an electrical submersible pump having a second embodiment of multi-diameter metal bellows.

Referring now to FIGS. 1A and 1B, shown is a typical submersible pump configuration wherein a seal section 10 is located between a pump section 12 and a motor section 14. Seal section 10 is made up of a lower seal section 16 (FIG. 1A) and an upper seal section 18 (FIG. 1B). Referring now in particular to FIG. 1A, lower seal section 16 has a housing 20. A base 22 is located in a lower end of a housing 20. Base 22 defines a sleeve receptacle 24. A lower shaft 26 is located within housing 20. A first sleeve 28 surrounds lower shaft 26 and is located in sleeve receptacle 24 of base 22. Lower sleeve block 30 is at least partially located within housing 20. Lower sleeve block 30 defines a sleeve receptacle 32 on a lower end and a collar receptacle 34 on an upper end. A second sleeve 36 is located within the sleeve receptacle 32 of lower sleeve block 30.

A lower guide tube collar 38 is located within collar receptacle 34 of lower sleeve block 30. A lower head 40 is at least partially located within housing 20 and is located above lower sleeve block 30. Lower head 40, housing 20 and lower sleeve block 30 define a lower bellows chamber 42. Lower head 40 defines a ring receptacle 44 on a lower end and a sleeve receptacle 46 above ring receptacle 44. Lower head 40 also defines a lower shaft seal receptacle 48 on an upper end. Fluid bypass conduit 50 and fluid passageway 52 are also defined by the lower head 40. Fluid passageway 52 communicates with an annular space that surrounds lower shaft 26 and also with lower bellows chamber 42. A check valve 54 is provided in fluid passageway 52 to prevent fluid from passing from the lower bellows chamber 42 back into fluid passageway 52.

A guide tube ring 56 is located within ring receptacle 44. A ring retainer collar 58 is threadably received on a guide tube ring 56. Ring retainer collar 58 is preferably provided with a ridge 60 for engaging an inside surface of housing 20. A lower guide tube 64 is located inside lower bellows chamber 42. Lower guide tube 64 is attached at a first end to the guide tube ring 56 and at a second end to lower guide tube collar 38 and surrounds lower shaft 26. Lower guide tube 64 is preferably provided with orifices 66 proximate an upper end up the lower guide tube 64. A first embodiment of a multi-diameter bellows 68 surrounds lower guide tube 64. Multi-diameter bellows 68 has a small diameter portion 70 and a large diameter portion 72. Bellows 68 may be made of metal or other high temperature resistant materials or other suitable materials as desired.

Figure 2A:
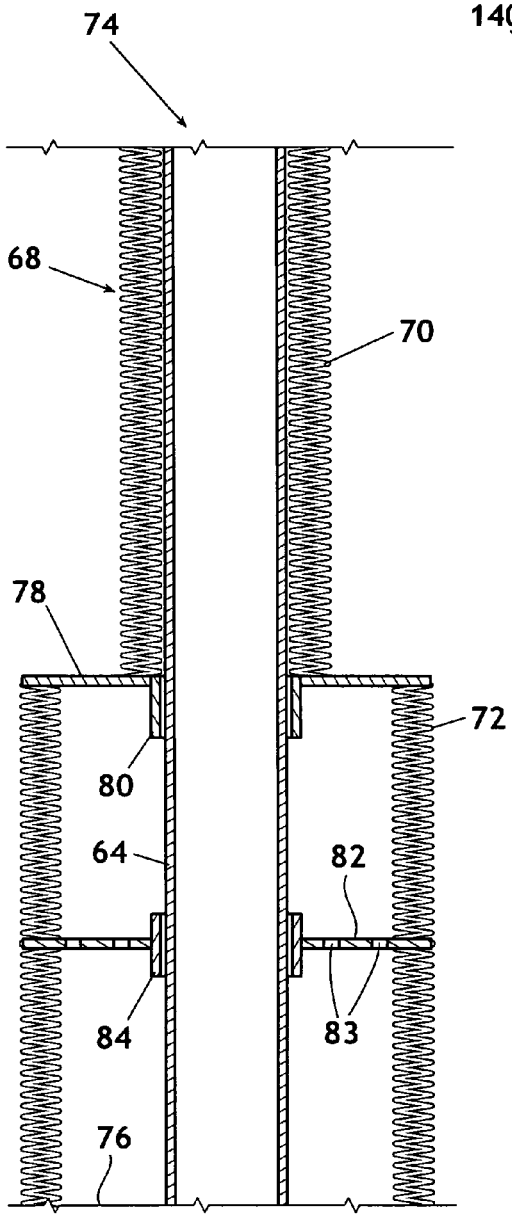
FIG. 2A is a schematic diagram of the first embodiment of the multi-diameter bellows of FIG. 1A shown in a neutral position.
Figure 2B:
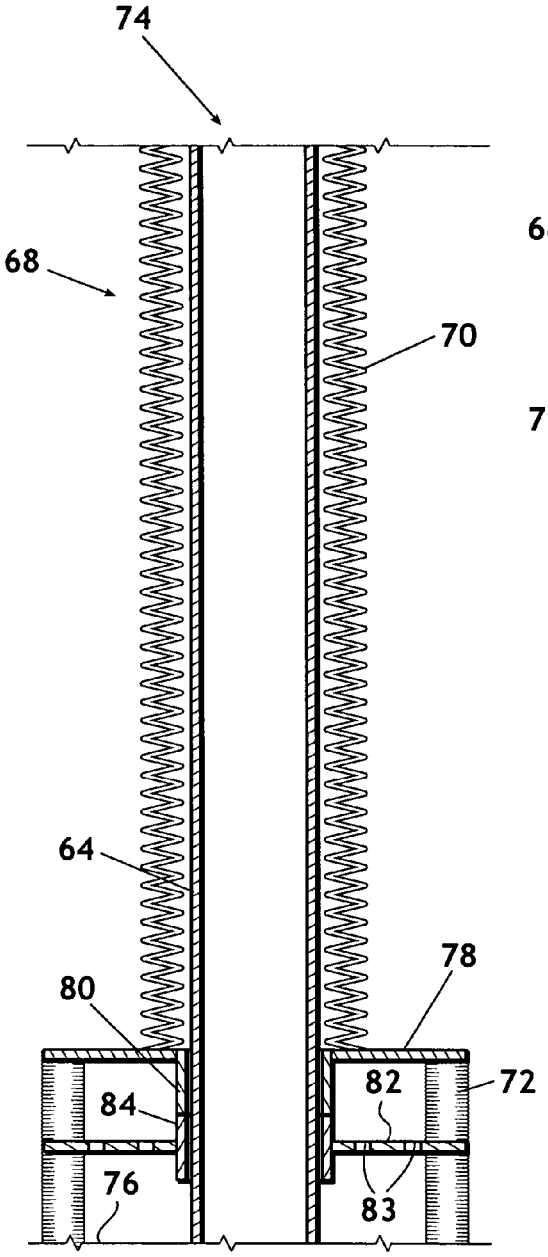
FIG. 2B is a schematic diagram of the first embodiment of the multi-diameter bellows shown in FIG. 1A shown in a fully collapsed or minimum volume configuration.
Figure 2C:
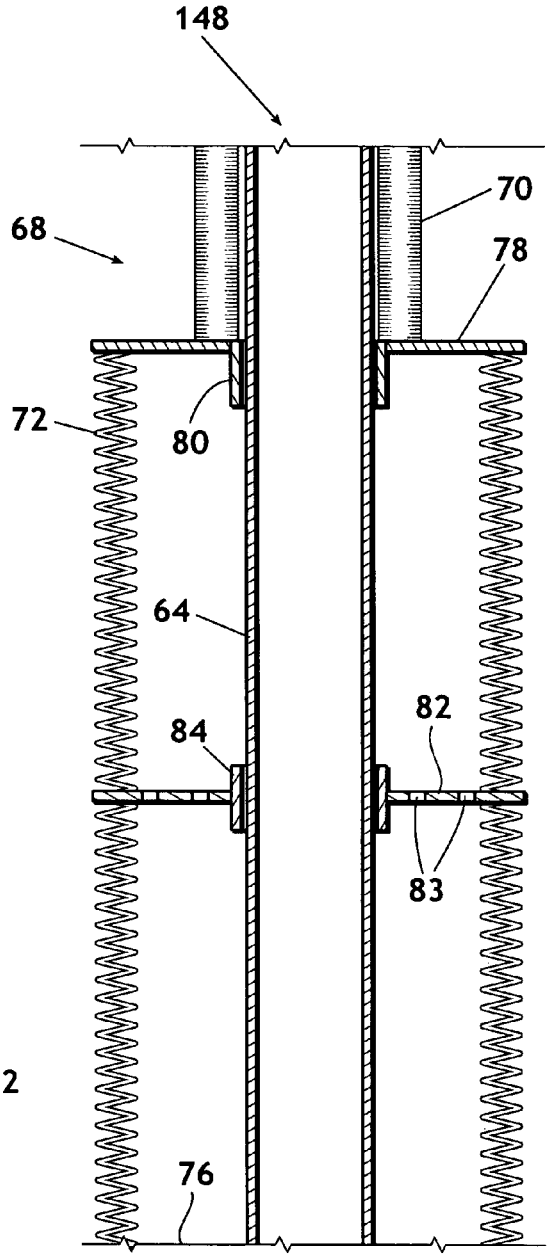
FIG. 2C is a schematic diagram of the first embodiment of the metal bellows of FIG. 1A shown in a completely expanded or maximum volume configuration.

Referring now to FIGS. 2A-2C, the multi-diameter bellows 68 can be seen in greater detail. Small diameter portion 70 has an upper end 74 affixed to ring retainer collar 58. Large diameter portion 72 has a lower end 76 affixed to lower guide tube collar 38. Small diameter portion 70 is separated from large diameter portion 72 by a coupling ring 78. Coupling ring 78 is attached to an upper end of large diameter portion 72 and to lower end of small diameter portion 70. Coupling ring 78 is preferably provided with a runner 80 for slidably engaging the lower guide tube 64. Multi-diameter bellows 68 is also preferably provided with at least one stabilizer disk 82 that is also provided with a runner 84 on an inner diameter of the stabilizer disk 82 for slidably engaging lower guide tube 64. Stabilizer disk 82 also communicates with an outer diameter of large diameter portion 72. Stabilizer disk 82 preferably has a first side attached to a segment of a large diameter portion 70 and has a second side attached to a separate segment of large diameter portion 72. Stabilizer disk 82 is preferably provided with orifices 83 formed therein for permitting fluid to pass therethrough within the multi-diameter bellows 68.

Referring back to FIG. 1A, a third sleeve 86 is located in the sleeve receptacle 46 of lower head 40. A lower shaft seal 88 is located partially in the lower shaft seal receptacle 48 of lower head 40. Lower shaft seal 88 is provided to prevent fluid migration along lower shaft 26. A coupling 90 is provided on an upper end of lower shaft 26.

Referring now to FIG. 1B, upper seal section 18 has an upper base 100 affixed to an upper end of lower head 40. An upper housing 102 has a lower end has is affixed to upper base 100. Upper base 100 has a sleeve receptacle 101 formed in an upper end. An upper shaft 104 passes through upper housing 102. Upper shaft 104 has a lower end that engages coupling 90. A fourth sleeve 105 is located in sleeve receptacle 101. Upper sleeve block 106 is at least partially located within upper housing 102. Upper sleeve block 106 defines a sleeve receptacle 108 at a lower end thereof and a collar receptacle 110 on an upper end. A fifth sleeve 112 is located within sleeve receptacle 108. A lower guide tube collar 114 is located within collar receptacle 110. Upper head 116 is at least partially located within upper housing 102 and above upper sleeve block 106. The upper head 116, the upper housing 102 and the upper sleeve block 106 define an upper bellows chamber 118. The upper head 116 defines a ring receptacle 120 on a lower end and a sleeve receptacle 122 above ring receptacle 120. Additionally, upper head 116 defines an upper shaft seal receptacle 124 on an upper end. Upper head 116 additionally defines a fluid passageway 126 that communicates an annular space around upper shaft 104 with the upper bellows chamber 118. A check valve 128 is provided for allowing fluid to pass from fluid passageway 126 to the upper bellows chamber 118. The portion of upper housing 102 that defines the upper bellows chamber 118 is provided with perforations 130 to allow well fluids to migrate into the upper bellows chamber 118 to equalize pressure between the upper bellows chamber 118 and the wellbore.

An upper guide tube ring 132 is located within ring receptacle 120. An upper guide tube 138 is attached to the lower guide tube collar 114 on a lower end and is attached to the upper guide tube ring 132 at an upper end. A second embodiment of a multi-diameter bellows 140 surrounds the upper guide tube 138. Multi-diameter bellows 140 has a first large diameter portion 142, a second large diameter portion 144, and a small diameter portion 146. Bellows 140 may be made of metal or other high temperature resistant materials or other suitable materials as desired.

Figure 3A:
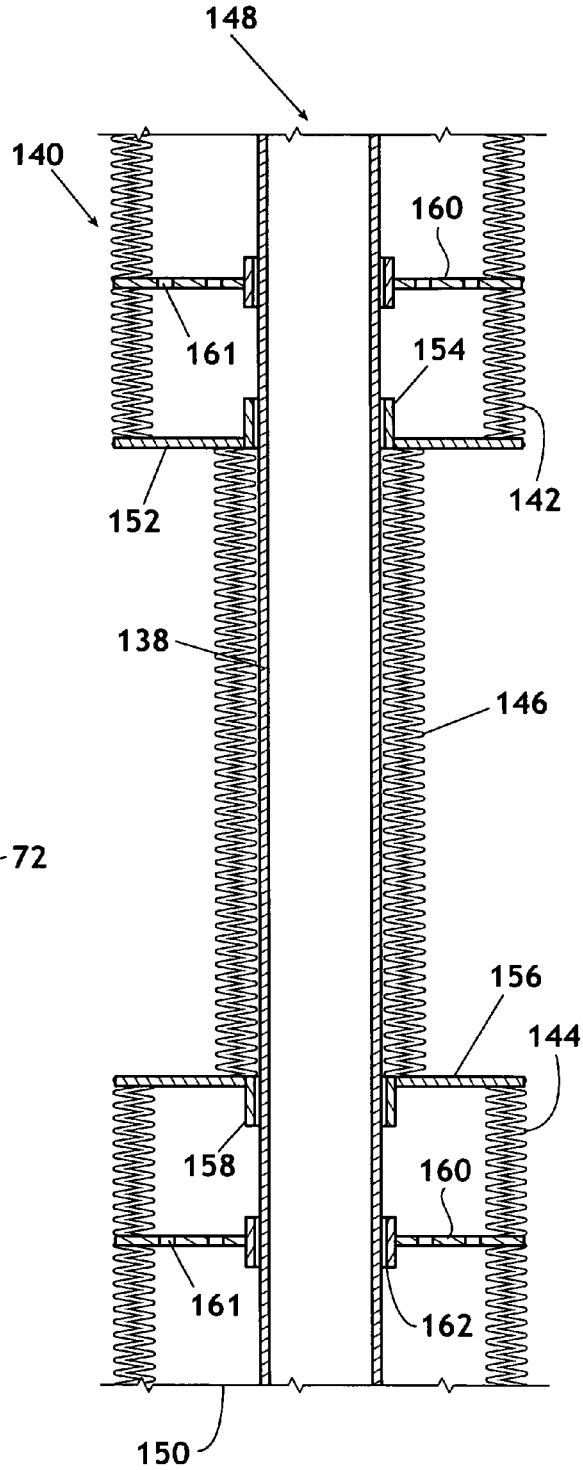
FIG. 3A is a schematic diagram of the second embodiment of the multi-diameter bellows shown in FIG. 1B shown in a neutral position.
Figure 3B:
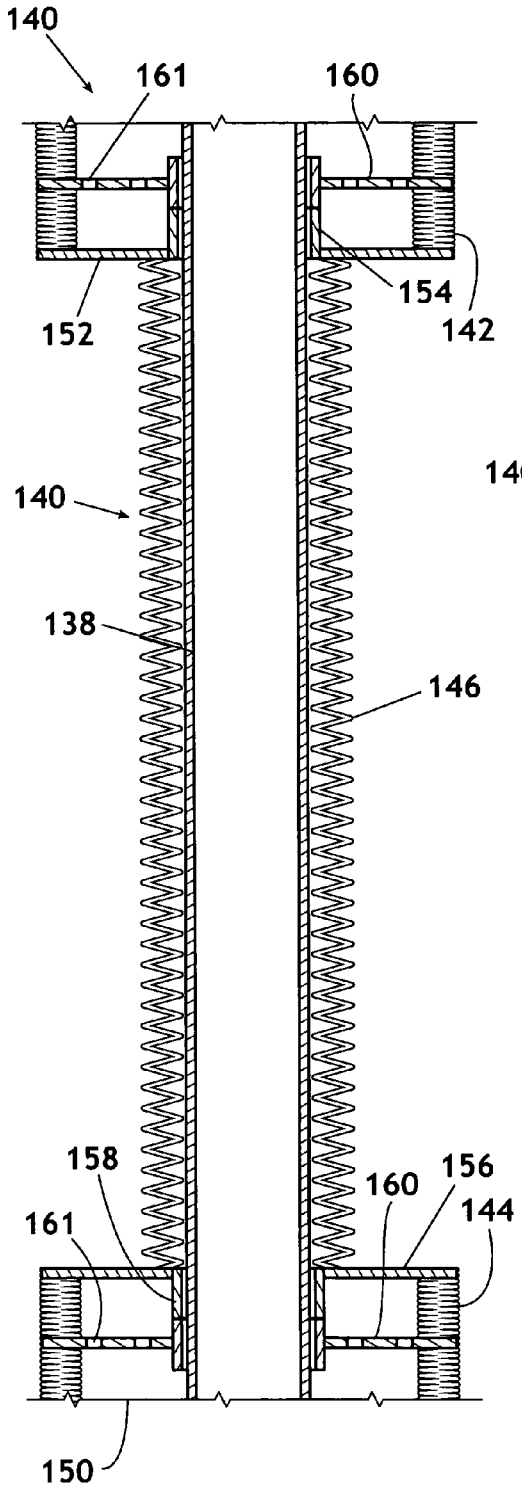
FIG. 3B is a schematic diagram of the second embodiment of the multi-diameter bellows shown in FIG. 1B shown in a fully retracted or minimum volume configuration.
Figure 3C:
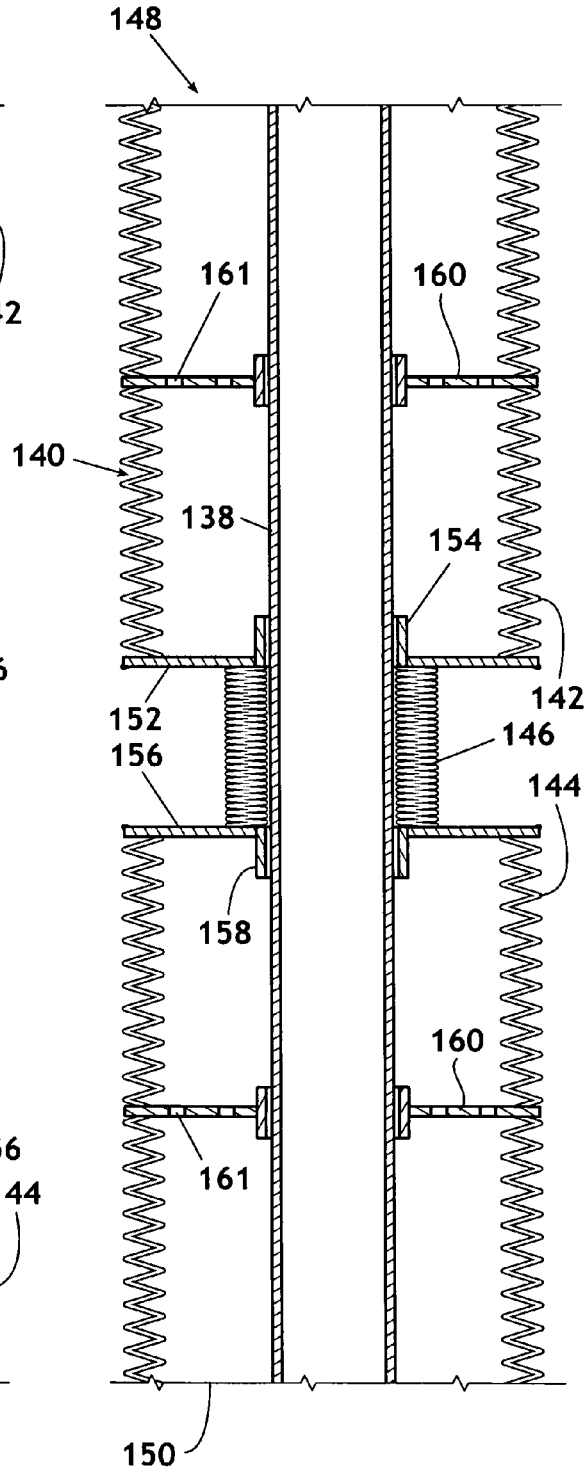
FIG. 3C is a schematic diagram of the second embodiment of the multi-diameter bellows shown in FIG. 1B shown in a fully expanded or maximum volume configuration.

Referring now to FIGS. 3A-3C, multi-diameter bellows 140 is shown in greater detail. An upper end 148 of the multi-diameter bellows 140 is affixed to the upper guide tube ring 132. A lower end 150 of the multi-diameter bellows 140 is affixed to the lower guide tube collar 114. Small diameter portion 146 is located between first large diameter portion 142 and second large diameter portion 144. A first end of the small diameter portion 146 engages the first large diameter portion 142 and is attached to a first coupling ring 152. First coupling ring 152 is attached to an upper end of the small diameter portion 146 and to a lower end of the first large diameter portion 142. The first coupling ring 152 preferably has a runner 154 located thereon for slidably engaging upper guide tube 138. A second end of the small diameter portion 146 is attached to the second large diameter portion 144 by a second coupling ring 156. Second coupling ring 156 is attached to a lower end of the small diameter portion 146 and to an upper end of second large diameter portion 144. Second coupling ring 156 is also preferably provided with a runner 158 for engaging the upper guide tube 138.

Multi-diameter bellows 140 also is preferably provided with a plurality of stabilizer disks 160 that have runners 162 provided on an inner diameter of the stabilizer disks 160 for slidably engaging upper guide tube 138. The stabilizer disks 160 communicate with an outer diameter of the first large diameter portion 142 and with an outer diameter of second large diameter portion 144. The stabilizer disks 160 preferably have a first side attached to a first segment of the first or second large diameter portions 142, 144 and a second side attached to a second segment of the first or second large diameter portions 142, 144. Stabilizer disks 160 are preferably provided with orifices 161 formed therein for permitting fluid to pass through the stabilizer disks 160 within the multi-diameter bellows 140.

Referring back to FIG. 1B, a sixth sleeve 164 is located in sleeve receptacle 122 of the upper head 116. An upper shaft seal 166 is located partially in the upper shaft seal receptacle 124 of the upper head 116. The upper shaft seal 166 is provided to prevent fluid migration along the upper shaft 104.

Figure 4A:
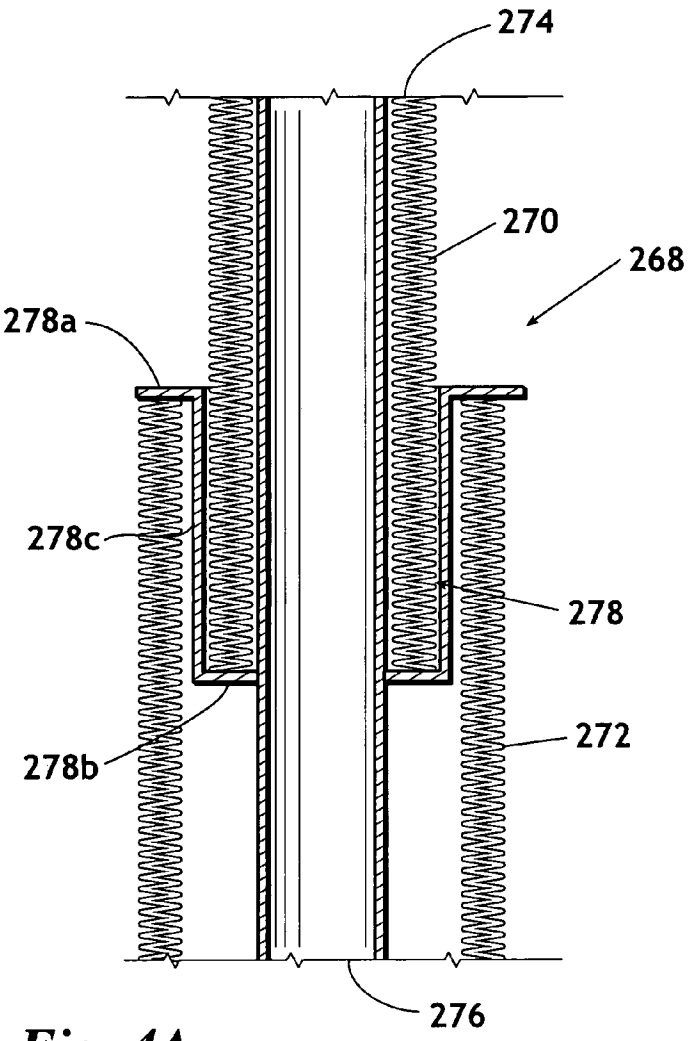
FIG. 4A is a schematic diagram of the first embodiment of a nested multi-diameter bellows shown in a neutral position.
Figure 4C:
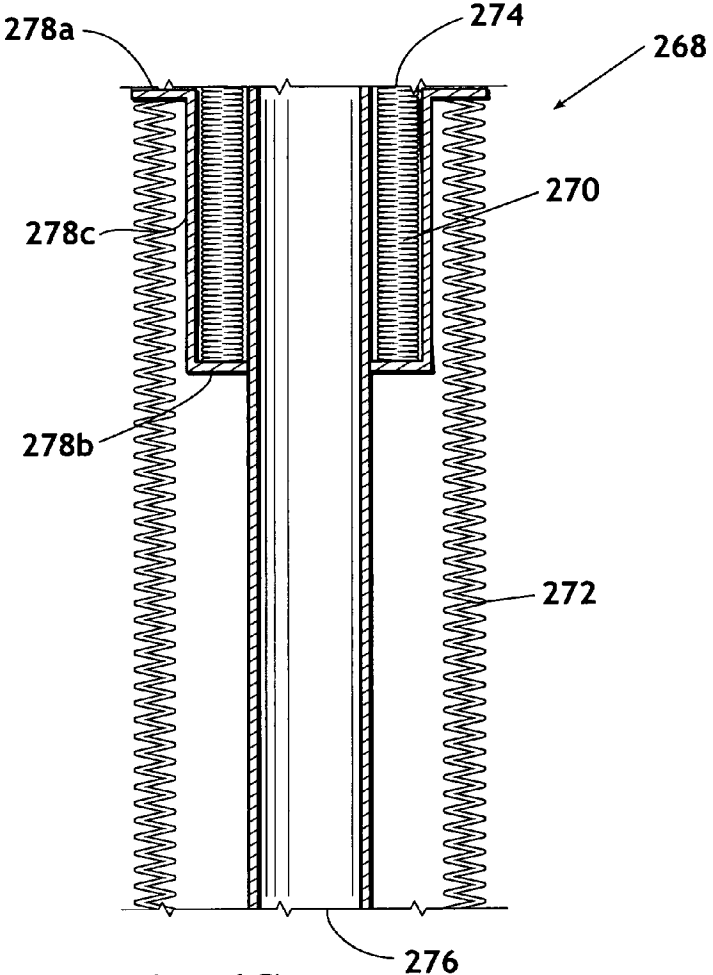
FIG. 4C is a schematic diagram of the first embodiment of the nested multi-diameter bellows shown in an expanded or maximum volume configuration.
Figure 4B:
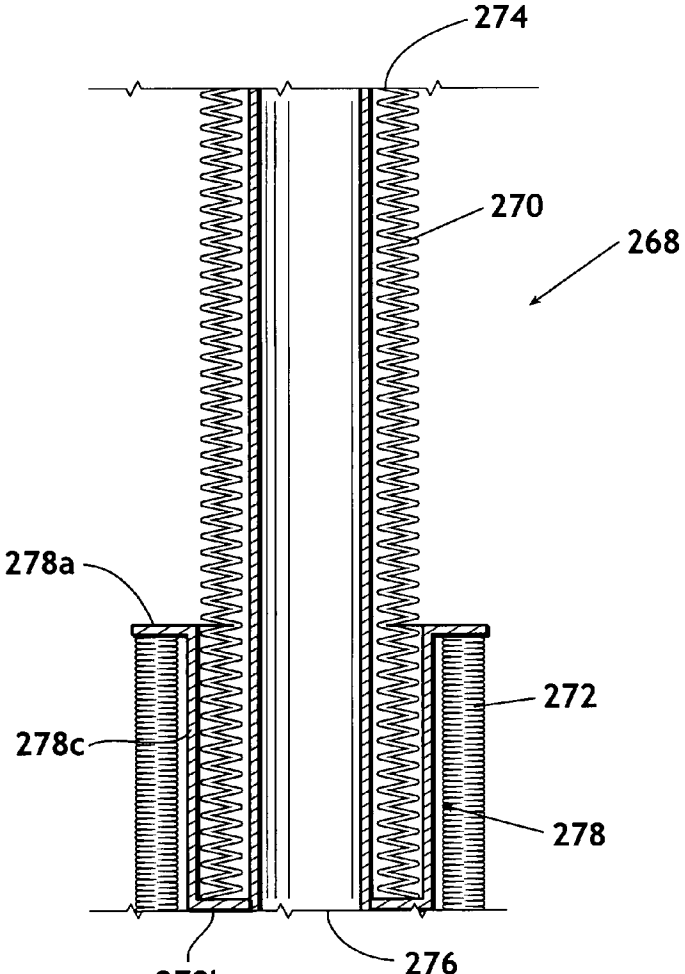
FIG. 4B is a schematic diagram of the first embodiment of the nested multi-diameter bellows shown in a fully collapsed or minimum volume configuration.

Referring now to FIGS. 4A-4C, a multi-diameter nested bellows 268 is shown. Small diameter portion 270 has an upper end 274 for affixing to a retainer such as collar 58 (FIG. 1A). Large diameter bellows portion 272 has a lower end 276 affixed to a retainer such as lower guide tube collar 38 (FIG. 1A). Small diameter bellows portion 270 is separated from large diameter bellows portion 272 by a coupling ring 278. Coupling ring 278 is attached to an upper end of large diameter bellows portion 272 and to lower end of small diameter bellows portion 270. Coupling ring 278 has an outside portion 278*a*, an inside portion 278*b* and a transitional portion 278*c*.

Figure 5A:
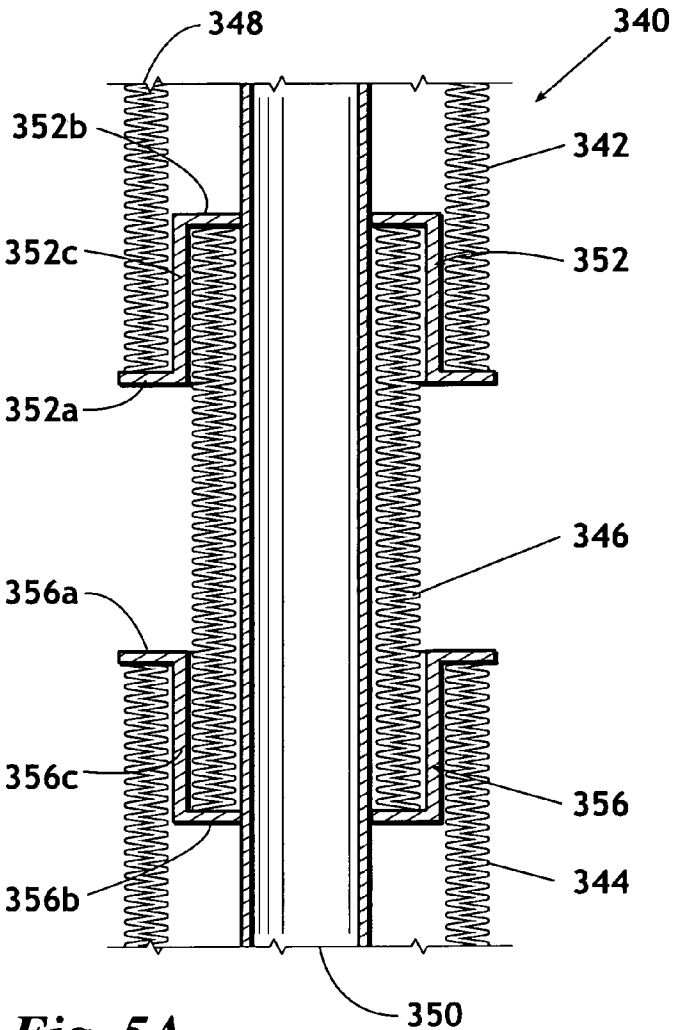
FIG. 5A is a schematic diagram of a second embodiment of a nested multi-diameter bellows shown in a neutral position.
Figure 5C:
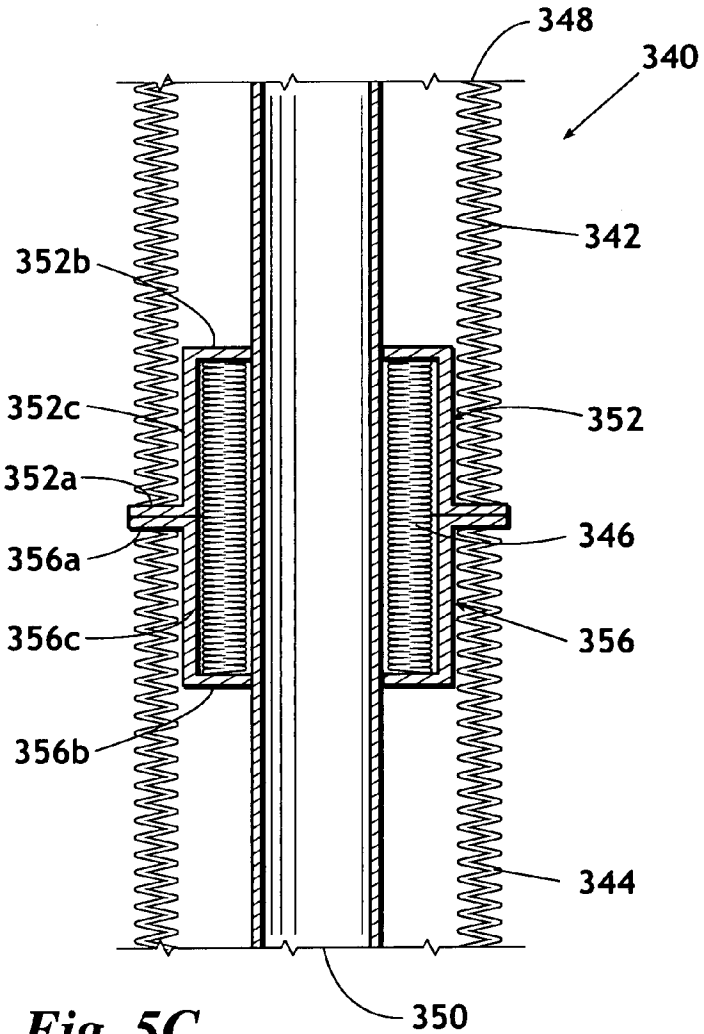
FIG. 5C is a schematic diagram of a second embodiment of a nested multi-diameter bellows shown in a fully expanded or maximum volume configuration.
Figure 5B:
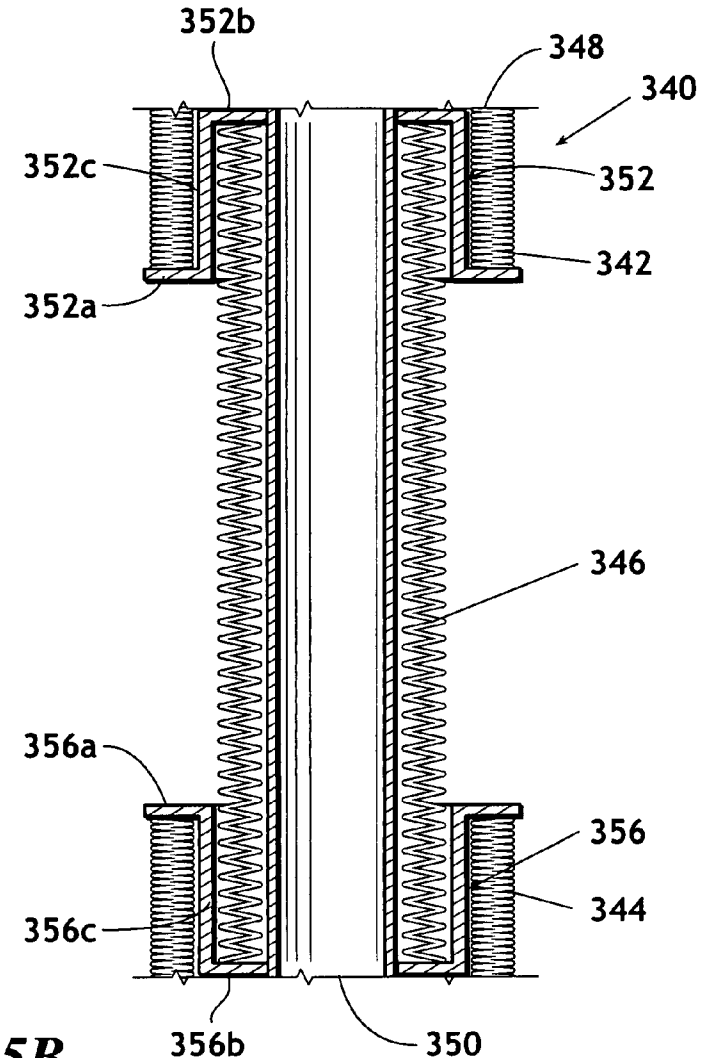
FIG. 5B is a schematic diagram of a second embodiment of a nested multi-diameter bellows shown in a fully retracted or minimum volume configuration.

Referring now to FIGS. 5A-5C, a second embodiment of multi-diameter bellows 340 is shown. An upper end 348 of the multi-diameter bellows 340 may be affixed to a retainer such as upper guide tube ring 32 (FIG. 1B). A lower end 350 of the multi-diameter bellows 340 may be affixed to a lower guide tube collar, such as collar 114 (FIG. 1B). Small diameter bellows portion 346 is located between first large diameter bellows portion 342 and second large diameter bellows portion 344. A first end of small diameter bellows portion 346 engages a first coupling ring 352 that is in communication with first large diameter bellows portion 342. First coupling ring 352 is attached to an upper end of the small diameter bellows portion 346 and to a lower end of the first large diameter bellows portion 342. The first coupling ring 352 has an outside portion 352*a*, an inside portion 352*b*, and a transitional portion 352*c*. A second end of the small diameter bellows portion 346 is attached to second large diameter bellows portion 344 by a second coupling ring 356. Second coupling ring 356 is attached to a lower end of the small diameter bellows portion 346 and to an upper end of second large diameter bellows portion 344. Second coupling ring 356 has an outside portion 356*a*, an inside portion 356*b*, and a transitional portion 356*c*.

In practice, dielectric fluid surrounding motor 14 is heated by operation of motor 14 and/or by conducting heat from the well environment. As a result, the dielectric fluid expands and migrates through base 22 past first sleeve 28 and up lower shaft 26. The dielectric fluid may continue to migrate past second sleeve 36, through lower sleeve block 30 and into the annular space between the lower shaft 26 and the lower guide tube 64. Once dielectric fluid migrates into lower guide tube 64, the dielectric fluid passes through orifices 66 in lower guide tube 64 and into the small diameter portion 70 of the multi-diameter bellows 68. The dielectric fluid may then fill the small diameter portion 70 and large diameter portion 72 of the multi-diameter bellows 68.

Once the volume within the multi-diameter bellows 68 is full of fluid, then coupling ring 78 will propagate along lower guide tube 64 to increase the volume within the large diameter portion 72 until such time as the small diameter portion 70 is fully compressed. When the small diameter portion 70 is fully compressed, then the multi-diameter bellows 68 is at full capacity. Once the multi-diameter bellows 68 is at full capacity, the dielectric fluid will migrate through fluid passageway 52 in lower head 40 and out through check valve 54 into the lower bellows chamber 42. Once lower bellows chamber 42 becomes full, the fluid may continue to migrate upwardly through fluid bypass conduit 50, which allows the fluid to bypass lower shaft seal 88.

If necessary, the dielectric fluid will continue to migrate upwardly in the seal section 10 past coupling 90 and into the upper seal section 18 where fluid will migrate through upper base 100 past fourth sleeve 105 and through the annular space surrounding the upper shaft 104, and through fifth sleeve 112 in upper sleeve block 106. Dielectric fluid will then continue to migrate up through the annular space between the upper shaft 104 and the upper guide tube 138 where the fluid migrates out of upper guide tube 138 and into the multi-diameter bellows 140.

The dielectric fluid fills first large diameter portion 142, small diameter portion 146, and second large diameter portion 144 of multi-diameter bellows 140. Once the internal volume of the multi-diameter bellows 140 is completely full of fluid, first coupling ring 152 and second coupling ring 156 propagate along upper guide tube 138 toward one another, thereby expanding the volume of the first large diameter portion 142 and second large diameter portion 144 while compressing small diameter portion 146. As more fluid is added to the multi-diameter bellows 140, the first large diameter portion 142 and second large diameter portion 144 will continue to expand until small diameter portion 146 is fully compressed as shown in FIG. 3C, which illustrates the maximum volume configuration of multi-diameter bellows 140. Dielectric fluid will then migrate up through fluid passageway 126 and out through check valve 128 where the dielectric fluid will co-mingle with well fluids that are able to enter through perforations 130 in upper housing 102. Therefore, the pressure within the multi-diameter bellows 140 will be maintained in equilibrium with wellbore pressure.

In the case of nested bellows 268 (FIGS. 4A-4C), once dielectric fluid passes into the small diameter bellows portion 270 of the multi-diameter bellows 268, the dielectric fluid may fill the small diameter bellows portion 270 and large diameter bellows portion 272 of the multi-diameter bellows 268.

As the volume within the multi-diameter bellows 268 fills with fluid, coupling member 278 will propagate along lower guide tube 64 to increase the volume within the large diameter bellows portion 272 until such time as the small diameter bellows portion 270 is fully compressed or until such time as outer portion 278*a* of coupling ring 278 makes contact with a retainer as shown in FIG. 4C.

In a preferred embodiment, outer portion 278*a* of coupling ring 278 functions as a stop against the retainer (FIG. 4C) to prevent over-compression of small diameter portion 270 or over-extension of large diameter portion 272, thereby avoiding the infliction of potentially damaging stress upon portions 270, 272. During operation, when small diameter portion 270 is fully compressed, the multi-diameter bellows 268 is at full capacity. Once the multi-diameter bellows 268 is at full capacity, the dielectric fluid will migrate out of bellows 268 through a fluid passageway.

Conversely, when nested bellows 268 is in a fully contracted or minimum volume configuration, as shown in FIG. 4B, large diameter bellows portion 272 is fully compressed and small diameter bellows portion 270 is fully expanded. In a preferred embodiment, inner portion 278*b* makes contact with a retainer and functions as a stop to prevent over expansion of small diameter bellows portion 270 or over compression of large diameter bellows portion 272.

With respect to the second embodiment of multi-diameter nested bellows 340 (FIGS. 5A-5C), dielectric fluid fills first large diameter bellows portion 342, small diameter bellows portion 346, and second large diameter bellows portion 344 of multi-diameter nested bellows 340. As the internal volume of the multi-diameter nested bellows 340 fills with fluid, first coupling member 352 and second coupling member 356 propagate along a guide tube, such as upper guide tube 38 (FIG. 1B) toward one another, thereby expanding the volume of first large diameter bellows portion 342 and second large diameter bellows portion 344 while compressing small diameter bellows portion 346.

As more fluid is added to the multi-diameter bellows 340, the first large diameter bellows portion 342 and second large diameter bellows portion 344 will continue to expand until small diameter bellows portion 346 is fully compressed or until outer portion 352*a* of first coupling member 352 and outer portion 356*a* of second coupling member 356 make contact, as shown in FIG. 5C. FIG. 5C illustrates the maximum volume configuration of multi-diameter bellows 340. When outer portions 352*a* and 356*a* are allowed make contact, outer portions 352*a* and 356*a* function as a stop to prevent over-expansion of first large diameter portion 342 and second large diameter portion 344 as well as over-compression of small diameter portion 344. Once first large diameter portion 342 and second large diameter portion 344 are completely expanded, then dielectric fluid will migrate up through a fluid passageway.

To minimize volume of bellows 340, small diameter bellows portion 346 is fully expanded while first large diameter bellows portion 342 and second large diameter bellows portion 344 are fully compressed, as shown in FIG. 5B.

In a preferred embodiment, inner portions 352*b* of first coupling member 352 will make contact with a stop, as shown in FIG. 5B, such as sleeve receptacle 32 (FIG. 1B). Similarly, as shown in FIG. 5B, inner portion 356*b* of second coupling member 356 will make contact with a stop, such as lower guide tube collar 114 (FIG. 1B). When inner portions 352*b* and 356*b* are allowed to bump against their respective stops, inner portions 352*b* and 356*b* function to prevent over-expansion of small diameter bellows portion 346 as well as over-compression first large diameter bellows portion 342 and second large diameter bellows portion 344.

Multiple embodiments of multi-diameter bellows are shown, i.e. multi-diameter bellows 68, 140, 268 and 340. The example bellows are shown located in a seal section 10 having a lower section 16 and an upper section 18. However, it should be understood that any of the multi-diameter bellows may be used in a seal section 10 having only a single section. Additionally, the multi-diameter bellows may be used in a seal section 10 having three or more sections as desired. Although seal section 10 is shown for purposes of example having both a first embodiment 68 and a second embodiment 140, the seal section 10 could be used with two or more of the first embodiments 68 or second embodiments 140, or embodiments 268 and 340 in any desired combination.

One advantage of the multi-diameter bellows is that the upper ends and lower ends are fixed. Therefore, the multi-diameter bellows occupy the same linear space of the seal section regardless of the volume of fluid located therein. The volume of the multi-diameter bellows is varied by movement of the coupling rings.

An additional advantage of the end mounted multi-diameter bellows is that the bellows surround the shafts. As a result, the multi-diameter bellows 68, 140 may be used above pump motor 14 in the same manner as elastomeric bags have been used previously.

While the invention has been described with a certain degree of particularity, it is understood that the invention is not limited to the embodiment(s) set for herein for purposes of exemplification but is to be limited only by the scope of the attached claim or claims including the full range of equivalency to which each element thereof is entitled.

What is claimed is:

1. A submersible pump comprising:

a motor containing a motor fluid;

a pump above said motor;

a seal section between said motor and said pump, said seal section defining a bellows chamber having a first end and a second end;

a shaft that communicates said motor with said pump, said shaft running through said bellows chamber in said seal section;

a communication tube in said bellows chamber surrounding said shaft, defining an annular passageway in fluid communication with the motor fluid;

a bellows in said bellows chamber and surrounding said communication tube, said bellows comprised of a first collapsible section and a second collapsible section said communication tube having an aperture for flowing said motor fluid from the passageway into an interior of said bellows;

said first collapsible section having a first end secured at said first end of said bellows chamber, said first collapsible section having a first cross-sectional area;

said second collapsible section having a second end secured at said second end of said bellows chamber, said second collapsible section having a second cross-sectional area larger than said first cross-sectional area;

a coupling member having an outside portion joined to a first end of said second collapsible section, an inside portion joined to a second end of said first collapsible section, and a transitional portion therebetween, said inside portion and said transitional portion being located within said second collapsible section, said coupling member surrounding said communication tube;

wherein said bellows has a fully expanded position wherein said second collapsible section is collapsed fully within said transitional portion of the coupling member, and said second collapsible section is fully extended with the outside portion of the coupling member bearing against a stop surface on the first end of the bellows chamber.

2. The bellows according to claim 1 wherein:

said first collapsible section and said second collapsible section are above said motor in said submersible pump.

3. The bellows according to claim 1 further comprising:

a stabilizer member in communication with one of said first collapsible section and said second collapsible section for suspending said one of said first collapsible section and said second collapsible section away from said shaft.

4. The bellows according to claim 3 wherein:

said stabilizer member slidingly engages a guide tube that surrounds said shaft.

5. The bellows according to claim 1 wherein:

said inside portion of said coupling member is located within said second collapsible section.

6. The submersible pump according to claim 1 wherein expansion of said second collapsible section is limited by abutment of said outside portion of said coupling member against said first end.

7. The submersible pump according to claim 1 wherein expansion of said first collapsible section is limited by abutment of said inside portion of said coupling member against said second fixed end.

8. The bellows according to claim 1 further comprising a third collapsible section between said first collapsible section and second collapsible section.

* * * * *